US006379146B1

(12) United States Patent
Zink et al.

(10) Patent No.: US 6,379,146 B1
(45) Date of Patent: Apr. 30, 2002

(54) FLOW DIVIDER FOR RADIANT WALL BURNER

(75) Inventors: Darton J. Zink; Rex K. Isaacs, both of Tulsa; John McDonald, Broken Arrow; Tim Kirk, Morris, all of OK (US)

(73) Assignee: Zeeco, Inc., Broken Arrow, OK (US)

( * ) Notice: Subject to any disclaimer, the term of this patent is extended or adjusted under 35 U.S.C. 154(b) by 0 days.

(21) Appl. No.: 09/828,722

(22) Filed: Apr. 9, 2001

(51) Int. Cl.[7] ..... F23C 1/12

(52) U.S. Cl. ..... 431/217; 110/265; 110/262; 239/423; 239/548; 431/181; 431/354

(58) Field of Search ..... 110/260, 261, 110/262, 263, 264, 265; 239/416.4, 416.5, 424.5, 548, 423, 427.5, 428; 431/8, 177, 181, 217, 187, 254, 202, 171, 353

(56) References Cited

U.S. PATENT DOCUMENTS 1,234,088 A * 7/1917 Ralston ..... 239/416.4
2,643,916 A * 6/1953 White et al. ..... 299/141
2,671,507 A * 3/1954 Morck ..... 158/99
2,808,876 A * 10/1957 Loof ..... 158/11
3,000,435 A * 9/1961 Bloom et al. ..... 158/11
3,198,436 A * 8/1965 Kurzinski et al. ..... 239/132
3,639,095 A * 2/1972 Zink et al. ..... 431/177
3,644,076 A * 2/1972 Bagge ..... 431/284
3,737,105 A * 6/1973 Arnold et al. ..... 239/423
4,014,654 A * 3/1977 Howell ..... 23/259.5
4,257,762 A * 3/1981 Zink et al. ..... 431/177
4,412,808 A * 11/1983 Sheppard et al. ..... 431/8
4,428,727 A * 1/1984 Deussner et al. ..... 431/182
4,702,691 A * 10/1987 Ogden ..... 431/187
5,680,823 A * 10/1997 LaRose ..... 110/262
5,957,678 A * 9/1999 Endoh et al. ..... 431/5

* cited by examiner

*Primary Examiner*—Ira S. Lazarus
*Assistant Examiner*—K. B. Rinehart
(74) *Attorney, Agent, or Firm*—Fellers, Snider, Blankenship, Bailey & Tippens, P.C.

(57) ABSTRACT

A flow divider for use in a gas burner assembly supported in an opening in a furnace wall has injected fluid, such as gas and/or air, flowing through an inner burner pipe then outwardly through a plurality of openings for burning along the surface of a wall thus providing a near uniform radiant heat energy to the furnace. The flow divider has a plurality of nested members and a plurality of in-line members to divide the flowing gas and/or air to improve distribution and to promote more uniform mixing of the gas and air.

24 Claims, 9 Drawing Sheets

FLOW DIVIDER FOR RADIANT WALL BURNER

FIELD OF THE INVENTION

This invention relates generally to an apparatus for a radiant wall burner assembly. More particularly, but in no way limiting, the present invention relates to a flow divider apparatus contained in a gas burner apparatus having a burner pipe.

BACKGROUND OF THE INVENTION

Radiant wall burners have been previously disclosed in the prior art. These prior art burners typically include the use of a burner pipe which is usually inserted into an oversized opening through the wall of a furnace terminating at a downstream end perpendicular to and beyond the inner wall of the furnace. The inner wall of the furnace surrounding the furnace opening typically includes a radiant wall surface which is substantially perpendicular to the burner pipe. The downstream end of the burner pipe is typically closed by a cap, plug, or other device. A plurality of openings, such as slots or holes, are provided in the side wall of the burner pipe at the downstream end to project a fluid mixture, such as a gas/air mixture, outwardly along the radiant furnace wall surface for burning.

Fuel is introduced into the burner pipe around its centerline, while air is introduced at or near the pipe's wall. While some mixing of the air and fuel occurs, due to the velocity of the gas/air mixture flow, the center portion of the flow stream remains fuel rich while the portion flowing near the furnace wall is fuel lean. When such a mixture combusts, the majority of the heat produced occurs away from the furnace wall, reducing effectiveness and efficiency of the furnace.

In order to assist the fluid flow from the burner pipe outward across the radiant wall, some prior art burners have utilized a flow divider which is inserted into the burner pipe. FIGS. 1–3 generally depict a typical prior art flow divider within a burner pipe. Unfortunately, however, the prior art flow dividers have not been able to adequately mix the fluid, especially around the centerline, into a uniform mixture prior to discharging into the furnace. These flow dividers continue to provide a fluid mixture which has a fuel rich center or downstream portion while having a fuel lean annular or upstream portion, as illustrated in FIG. 3.

U.S. Pat. No. 2,671,507, issued to Morck, which is incorporated herein by reference, discloses a radiant gas burner having a distributor for dividing the flow stream into a plurality of gas streams. The distributor utilizes a centralized plug and a plurality of fins to provide passages for the gas streams.

U.S. Pat. No. 4,702,691, issued to Ogden, which is incorporated herein by reference, discloses a radiant gas burner having a single cylindrical flow divider for dividing the flow stream into an upstream portion and a downstream portion. The flow divider creates a substantially undivided annular space between the burner pipe wall and the flow divider through which the upstream portion flows and an undivided inside central space within the flow divider through which the downstream portion flows. This device unfortunately does not provide for sufficient mixing of the fluid stream. Thus, the fluid stream remains primarily fuel rich along its downstream, or center, portion.

This invention is an improvement upon the radiant wall burning apparatuses heretofore developed. Specifically, the invention is directed to an improved flow divider for use in radiant wall burners.

SUMMARY OF THE INVENTION

The present invention provides a flow divider apparatus for a gas burner assembly which satisfies the needs and alleviate the problems discussed above. The inventive flow divider apparatus provides uniform flow velocities and also provides improved distribution of air or gas-air mixtures through the openings or slots provided in the end portion of the burner pipe.

A typical gas burner assembly in which the inventive flow divider apparatus is utilized can be employed, for example, in furnaces in which a high velocity fuel gas enters a burner pipe via an orifice to mix with combustion supporting air in a mixing section of the burner pipe. The burner pipe will typically be inserted into an oversized opening through the wall of the furnace such that the burner pipe is substantially perpendicular to, and the downstream end thereof extends beyond, the inner wall of the furnace. The inner wall of the furnace surrounding the furnace opening typically includes a radiant wall surface which is substantially perpendicular to the burner pipe. The downstream end of the burner pipe is typically closed by a cap, plug, or other device. A plurality of lateral side wall openings, such as slots or holes, are provided in the downstream end portion of the burner pipe to discharge the gas-air mixture outwardly along the radiant furnace wall surface for burning. Generally, the flow divider of the present invention is placed within the burner pipe near the downstream end thereof in order to divide the flow stream into a plurality of separate flow streams, each preferably being discharged at a different longitudinal location in the side wall of the burner pipe proximate to its distal end.

The present invention allows the fluid stream to mix more thoroughly due to turbulence caused by the impact of the fluid stream with the divided center section. This more thorough mixing of the fuel and air contained in the fluid stream allows for a more uniform and efficient distribution of fuel/air gases than previously provided by the prior art devices. As a result of the more uniform distribution of the fuel and air mixture, combustion is more balanced and a more even heat flux is provided.

In one aspect, the present invention involves a gas burner assembly for use in a furnace in which fluid flows therethrough. The assembly comprises: (a) a burner pipe through which fluids flow and (b) a flow divider comprising a plurality of nested members within said burner pipe defining an annular flow space between the side wall of the burner pipe and the outermost member, a core space within the innermost member, and at least one midstream space between the nested members. The burner pipe includes a plurality of openings or slots provided in the side wall of the burner pipe proximate to its distal (downstream) end.

As used herein, the term nested refers to the interfitting of two or more members. For example, when the number of nested members is two, there would be an outer member and an inner member. When the number of nested members is three, there would be an outer member, an inner member, and a midstream member located between the outer member and inner member.

The inventive flow divider is preferably positioned inside the burner pipe at the downstream end. The fluid stream is divided into a downstream portion which passes through the core space, an upstream portion which passes through the annular space, and at least one mid-stream portion which passes through at least one midstream space. The fluid stream then passes out the plurality of openings located in the burner pipe. The fluid which flows therethough can be, but is not limited to, a combination of pre-mixed fuel and aspirated combustion supporting air.

By way of example, when the flow divider of the present invention has two nested members, an annular flow space is formed between the side wall of the burner pipe and the outer member, a core space is formed within the inner member, and a midstream space is formed between the outer member and the inner member. When the number of nested members is three, an annular flow space is formed between the side wall of the burner pipe and the outermost member, a core space is formed within the innermost member, a first midstream space is formed between the outermost member and the middle member, and a second midstream space is formed between the middle member and the innermost member.

In another aspect of the inventive flow divider, the cross-section of each of the nested members is substantially cylindrical. It will, however, be understood by those skilled in the art that other geometric cross-sections could be utilized.

In another aspect of the inventive flow divider, each of the openings or slots around the downstream end portion of the burner pipe is divided into a downstream portion, an annular portion, and at least one midstream portion by flaring the downstream ends of the plurality of nested members such that they intersect and divide the openings in the side wall of the burner pipe. This flaring can be configured in a curved, tapered or beveled manner. Alternatively, a squared radial (i.e. substantially 90°) flaring perpendicular to the burner pipe openings can be used.

In yet another aspect, the flow divider of the present invention comprises a plurality of in-line members defining a plurality of flow sections. These plurality of in-line members preferably intersect along a longitudinally extending centerline or edge and generally extend radially from the centerline or edge toward the side wall of the burner pipe. The plurality of flow sections are defined by the spaces created between adjacent in-line members.

By way of example, when the number of in-line members is three, each extending from a common edge or centerline located substantially along the centerline of the burner pipe, a first flow section is created between the first in-line member, the second in-line member and the side wall, a second flow section is created between the second in-line member, the third in-line member and the side wall, and a third flow section is created between the third in-line member, the first in-line member and the side wall.

In yet another aspect, the present invention involves a gas burner assembly for use in a furnace in which fluid flows therethrough. The assembly comprises: (a) a burner pipe through which fluids flow and (b) a flow divider comprising a plurality of nested members within said burner pipe defining an annular flow space between the inside diameter of the burner pipe and the outermost nested member, a core space within the innermost nested member, and at least one midstream space between the nested members, and (c) a plurality of in-line members defining a plurality of flow sections, further dividing the annular space, the core space, and/or the midstream space(s), either individually or in combination. The burner pipe includes a plurality of openings or slots provided in the side wall of the burner pipe proximate to its distal (downstream) end.

By way of example, when the flow divider of this aspect of the present invention has two nested members and three in-line members, an annular flow space is formed between the side wall of the burner pipe and the outer member, a core space is formed within the inner member, and a midstream space is formed between the outer member and the inner member. The in-line members further divide the annular space, core space and/or midstream space into flow sections.

It is understood that the in-line members can divide the annular space, core space and midstream space either individually or in combination. By way of example, the in-line members may only be placed within the core space, thus dividing only the core space while not affecting the remaining flow spaces. By further example, the in-line members may only be placed within the core space and at least one midstream space, further dividing those spaces while not affecting the remaining spaces.

A better understanding of the present invention, its several aspects, and its advantages will become apparent to those skilled in the art from the following detailed description, taken in conjunction with the attached drawings, wherein there is shown and described the preferred embodiments of the invention, simply by way of illustration of the best mode contemplated for carrying out the invention.

DETAILED DESCRIPTION OF THE PREFERRED EMBODIMENTS

Before explaining the present invention in detail, it is to be understood that the invention is not limited in its application to the details of the construction and arrangement of parts illustrated in the accompanying drawings. The invention is capable of other embodiments and of being practiced or carried out in a variety of ways. It is to be understood that the phraseology and terminology employed herein is for the purpose of description and not of limitation.

Figure 1:
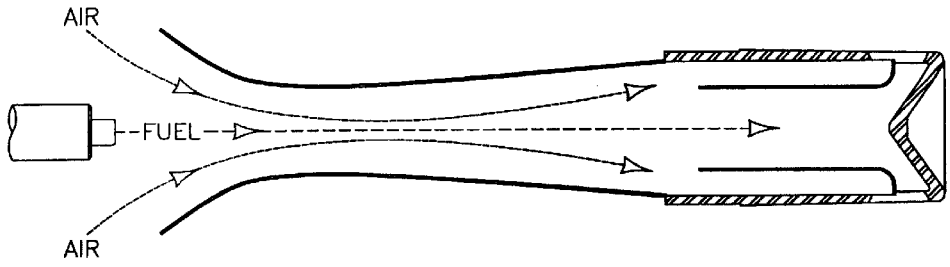
FIGS. 1–3 demonstrate prior art flow dividers.
Figure 2:
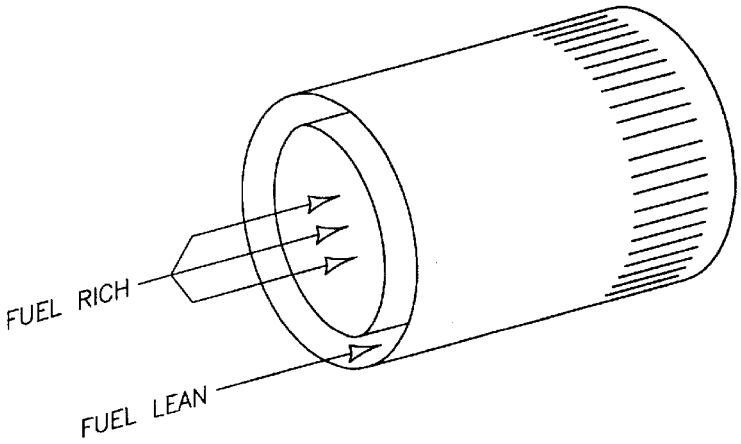
Figure 3:
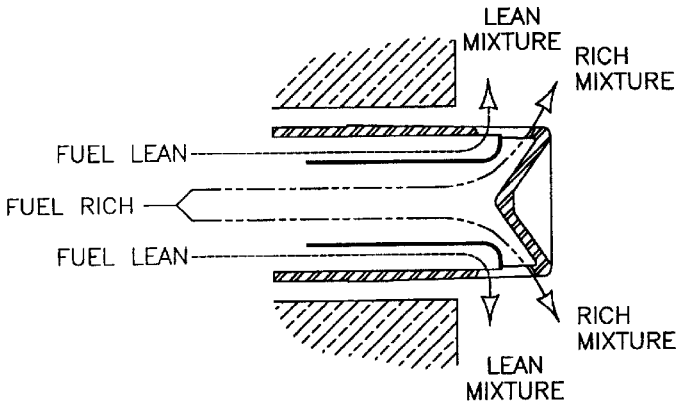
Figure 4:
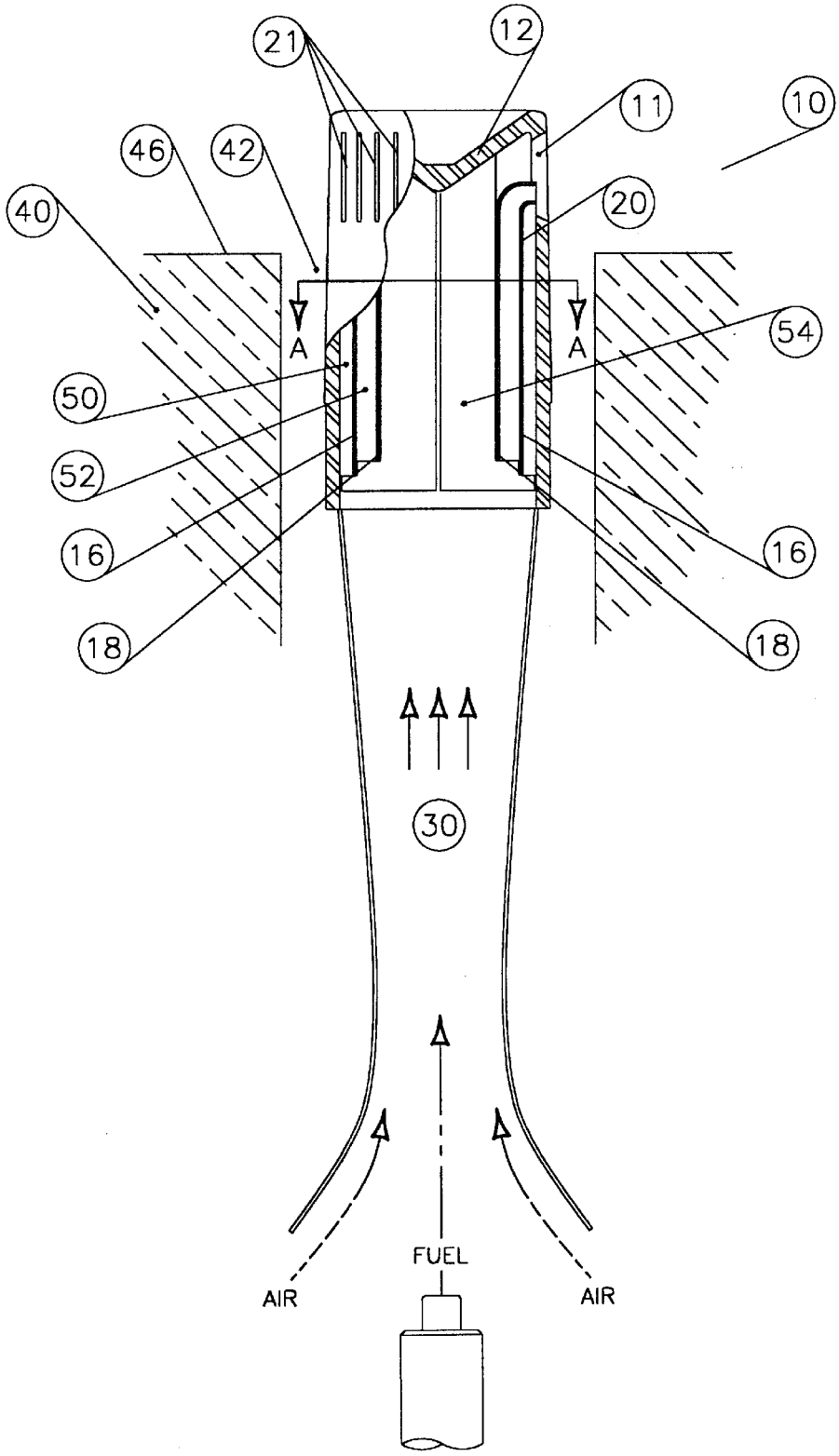
FIG. 4 is a perspective view of a radiant wall burner incorporating an embodiment 10 of the flow divider of the present invention.
Figure 5:
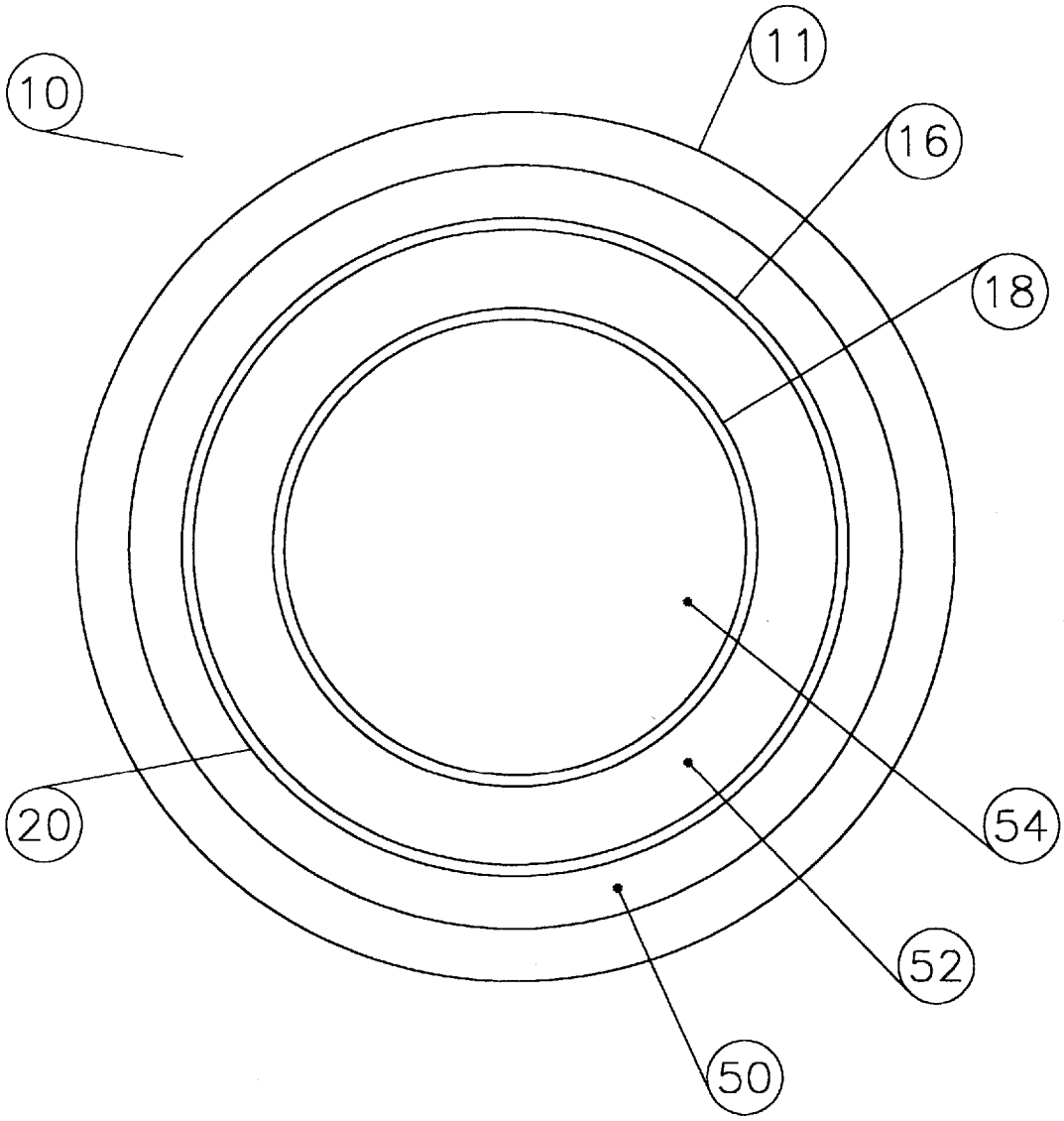
FIG. 5 is a cross-sectional view of embodiment 10 show in FIG. 4 along line AA.

An embodiment 10 of the present invention is generally illustrated in FIGS. 4 and 5. Embodiment 10 comprises a burner pipe 11, which is inserted through an opening 42 located through a furnace wall 40, having a flow divider 20 preferably provided in the interior of burner pipe 11 adjacent the downstream end. Flow divider 20 preferably comprises a plurality of nested members within burner pipe 11. Although shown as a gas-air mixing burner assembly, it will be understood by those skilled in the art that the inventive gas burner assembly could be could be used with other burner assemblies.

As used herein, the term nested refers to the interfitting of two or more members. For example, when the number of nested members is two, there would be an outer member and an inner member. When the number of nested members is three, there would be an outer member, an inner member, and a midstream member located between the outer member and inner member.

As stated, this invention is directed to improvements in the flow of the fluids, such as gas-air mixtures, from the downstream end of the burner pipe 11. A plug 12 is preferably positioned to close the downstream end of pipe 11. Plug 12 is conical but other types of plugs, caps or similar devices could also be used. A plurality of spaced, lateral openings or slots 21 are provided around the circumference of the side wall of the downstream end of the burner pipe 11. The gas and air mixture is discharged radially outward through openings 21 for burning along the inner furnace wall and tile surface 46.

As shown in FIGS. 4 and 5, flow divider 20 is shown as having a plurality of nested cylindrical members comprising a first cylindrical member 16 and a second cylindrical member 18. The nested cylindrical members create a plurality of separate spaces through which the flow stream travels. An annular space 50 is created between the interior wall of burner pipe 11 and first cylindrical member 16. A midstream space 52 is created between first cylindrical member 16 and second cylindrical member 18. A core space 54 is created within second cylindrical member 18.

It will be understood by those skilled in the art that, while the nested members of this embodiment have a cylindrical cross-section, other geometric cross-sections could be utilized.

In one aspect, the various surfaces of flow divider 20 provide a substantial amount of surface area over which the fluid must travel. This increased contact operates to significantly increase the amount, and enhances the uniformity of, mixing occurring in the inventive apparatus.

It is noted one or generally any other number of nested members can be in the present invention. Further, as will be understood by those skilled in the art, the inventive flow divider 20 can be either removably installed or permanently installed in burner pipe 11.

Figure 6:
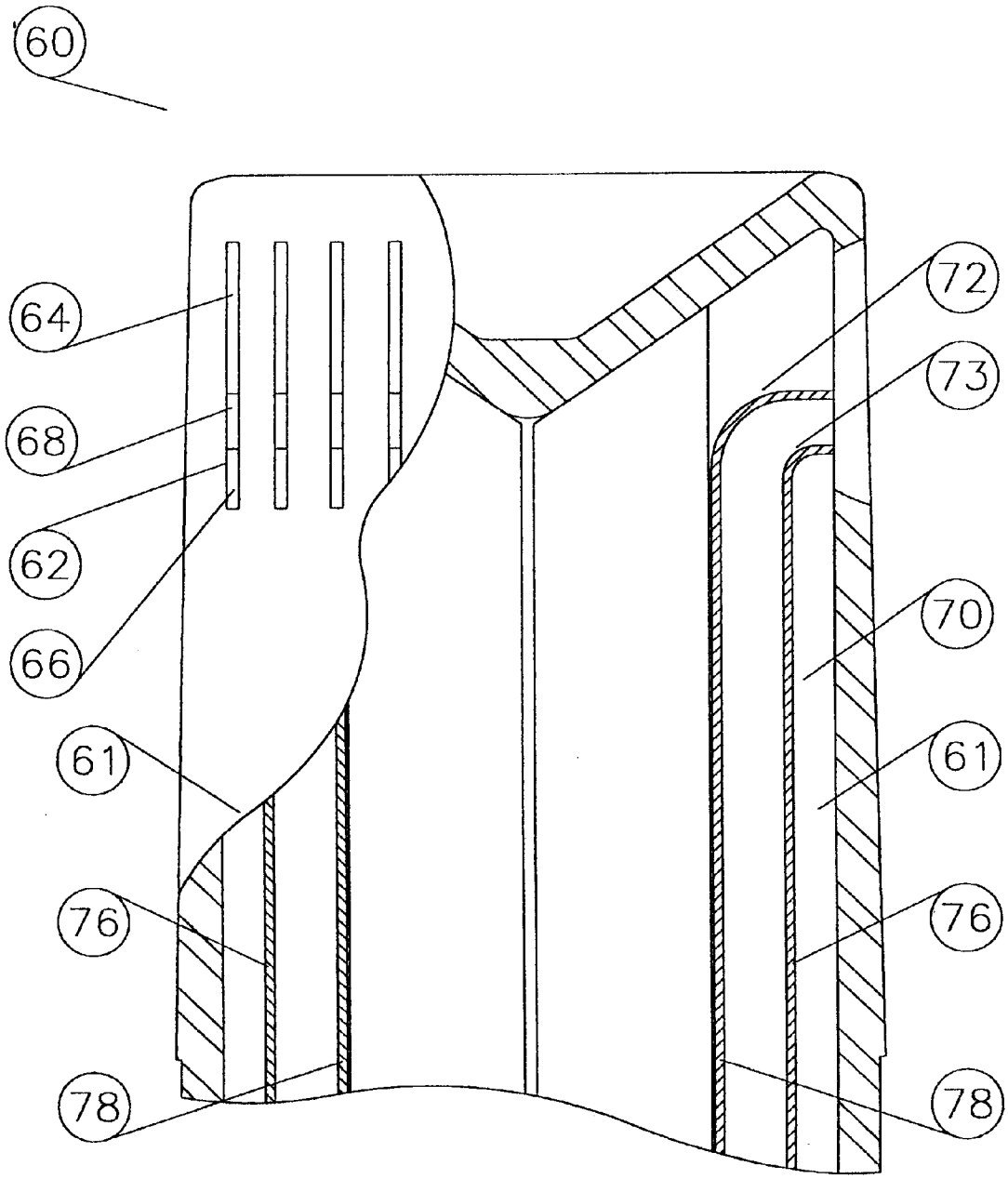
FIG. 6 is a perspective view of the radiant wall burner incorporating an embodiment 60 of the flow divider of the present invention showing the side wall slots located therein.

In another embodiment 60, as shown in FIG. 6, the downstream ends 72 of the nested members employed in flow divider 70 are preferably flared (i.e., curved, shaped, flanged or otherwise directed outwardly) so as to intersect the lateral sidewall openings 62 provided around the downstream end portion of burner pipe 61, thus dividing each of the openings 62 into a plurality of opening sections. By way of example, flow divider 70 is shown as having two nested members 76 and 78 each of which includes a curved flared downstream end 72 and 73. These curved flared downstream ends 72 and 73 intersect openings 62 and thereby divide each of openings 62 into a downstream opening section 64, an upstream opening section 66 and a midstream opening section 68, as shown in FIG. 6. It will be understood by those skilled in the art that the number of opening sections created will increase as the number of nested members increases.

Figure 7:
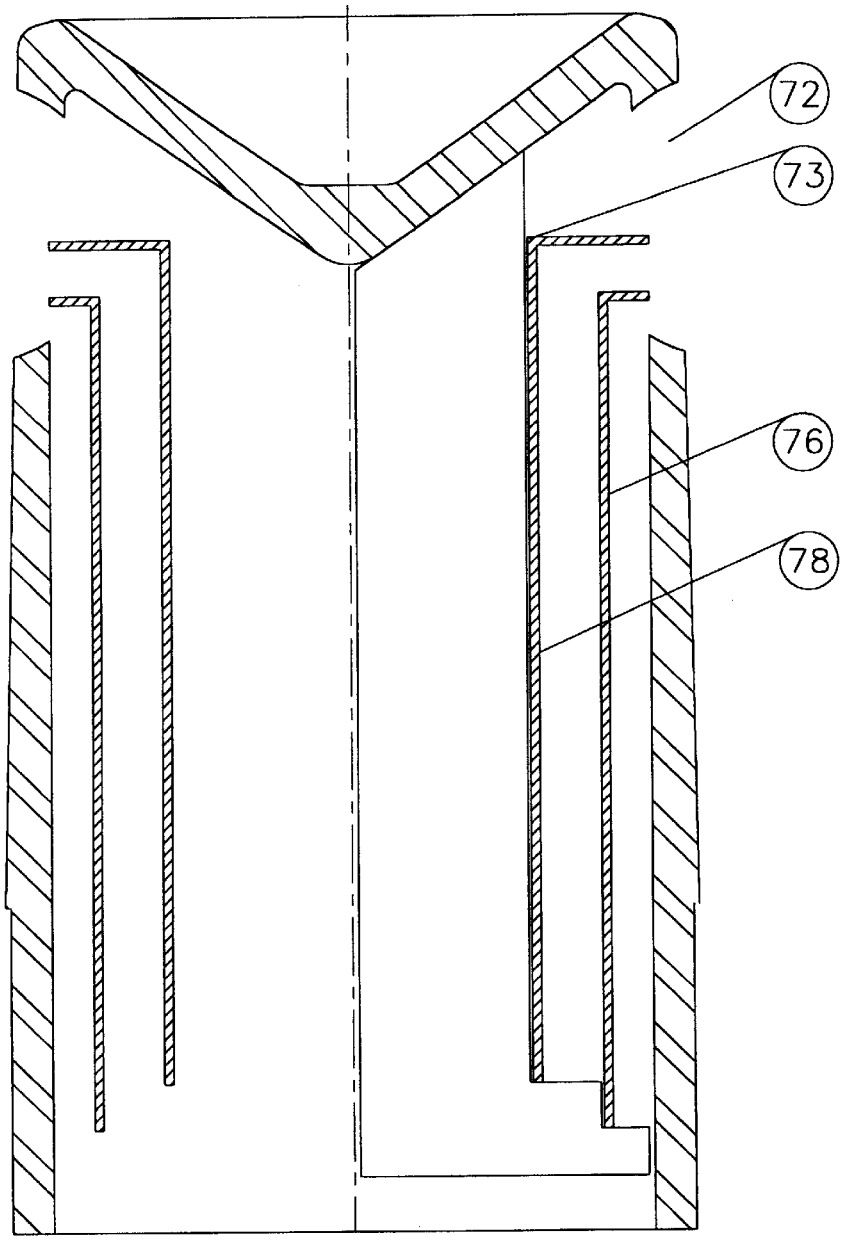
FIGS. 7–8 illustrate alternative embodiments of the flow divider of the present invention.
Figure 8:
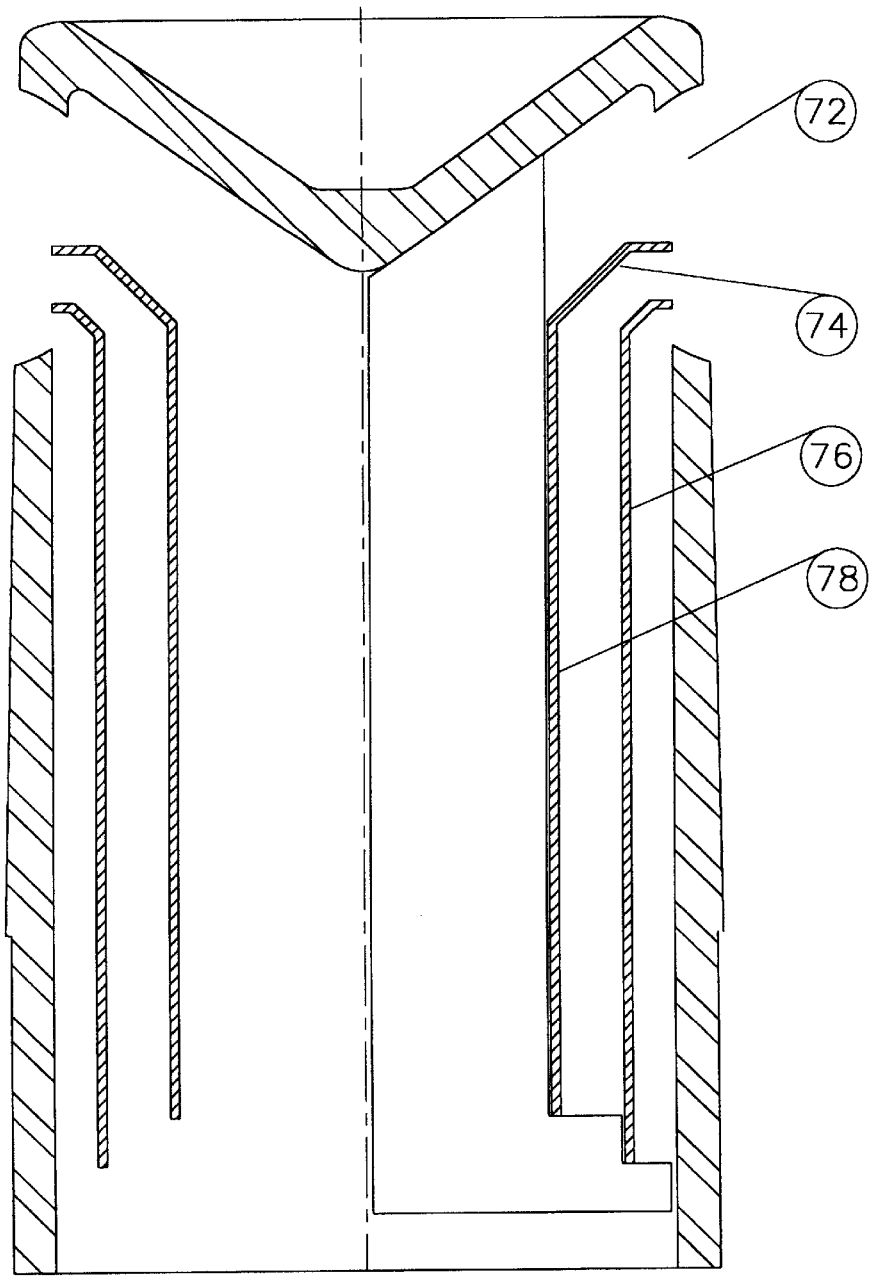

In the embodiment depicted in FIGS. 7 and 8, the flared downstream ends of the nested member can comprise, for example, a tapered surface 74 and/or a perpendicular surface 73.

Figure 9:
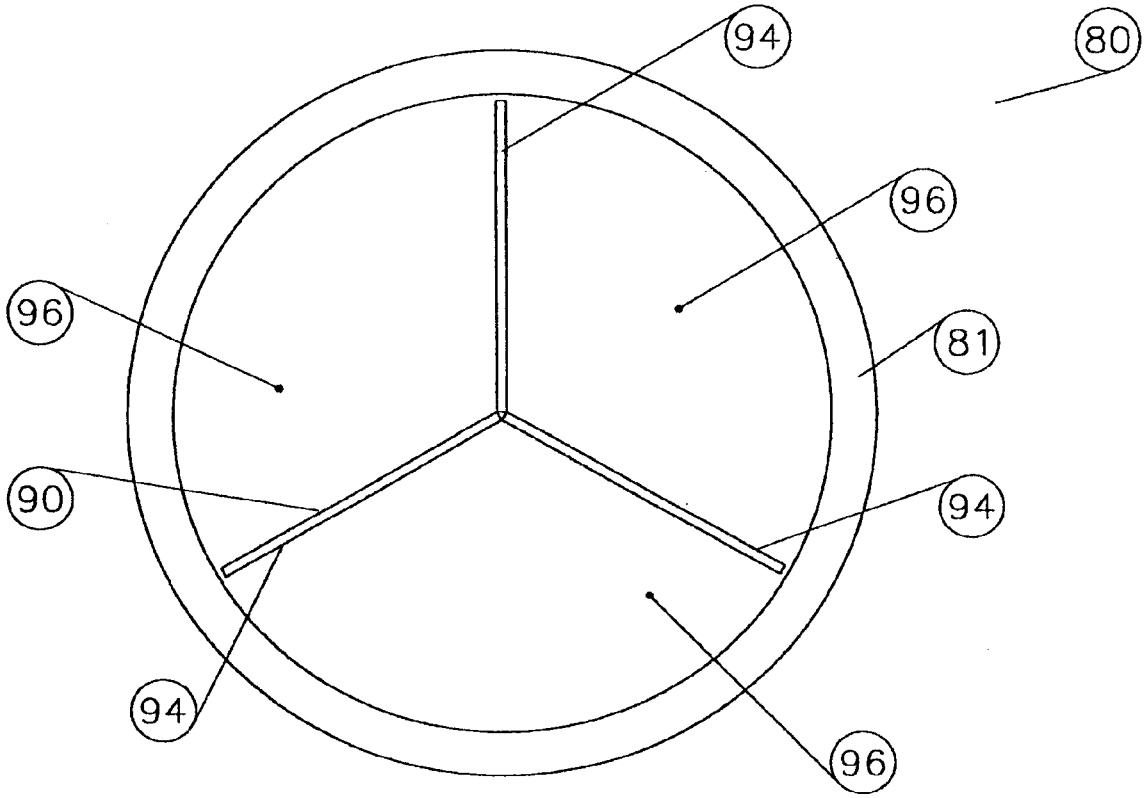
FIG. 9 is a bottom view of embodiment 80 of the flow divider of the present invention.

As illustrated in FIG. 9, another embodiment 80 of the present invention comprises a burner pipe 81 having a flow divider 90 preferably provided in the interior of burner pipe 81 adjacent the downstream end. Flow divider 90 preferably comprises a plurality of in-line members 94 which divide the flow stream into flow sections. These plurality of in-line members generally comprise a plurality of plates having a common central, longitudinal edge and extending radially toward the side wall of the burner pipe. The plurality of flow sections are defined by the spaces created between adjacent in-line members and the inner wall of the burner pipe.

Figure 10:
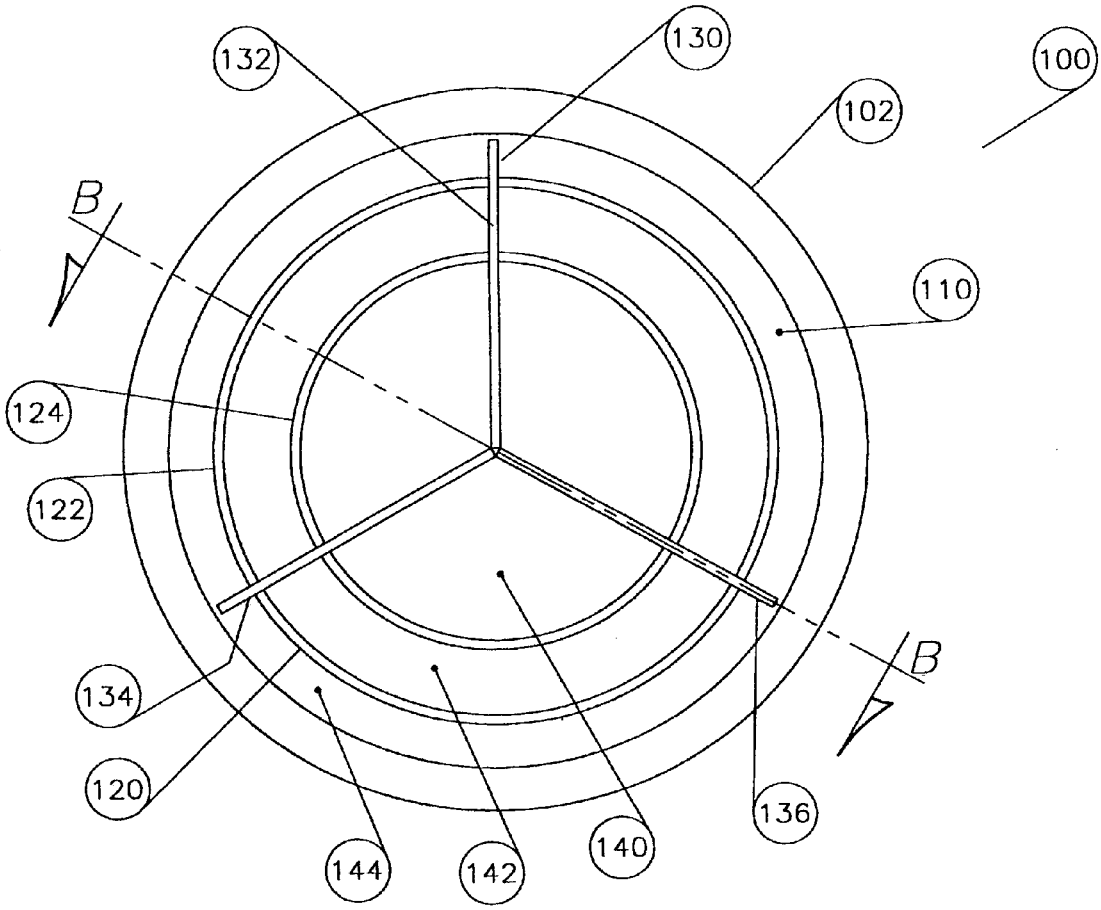
FIG. 10 is bottom view of embodiment 100 of the flow divider of the present invention
Figure 11:
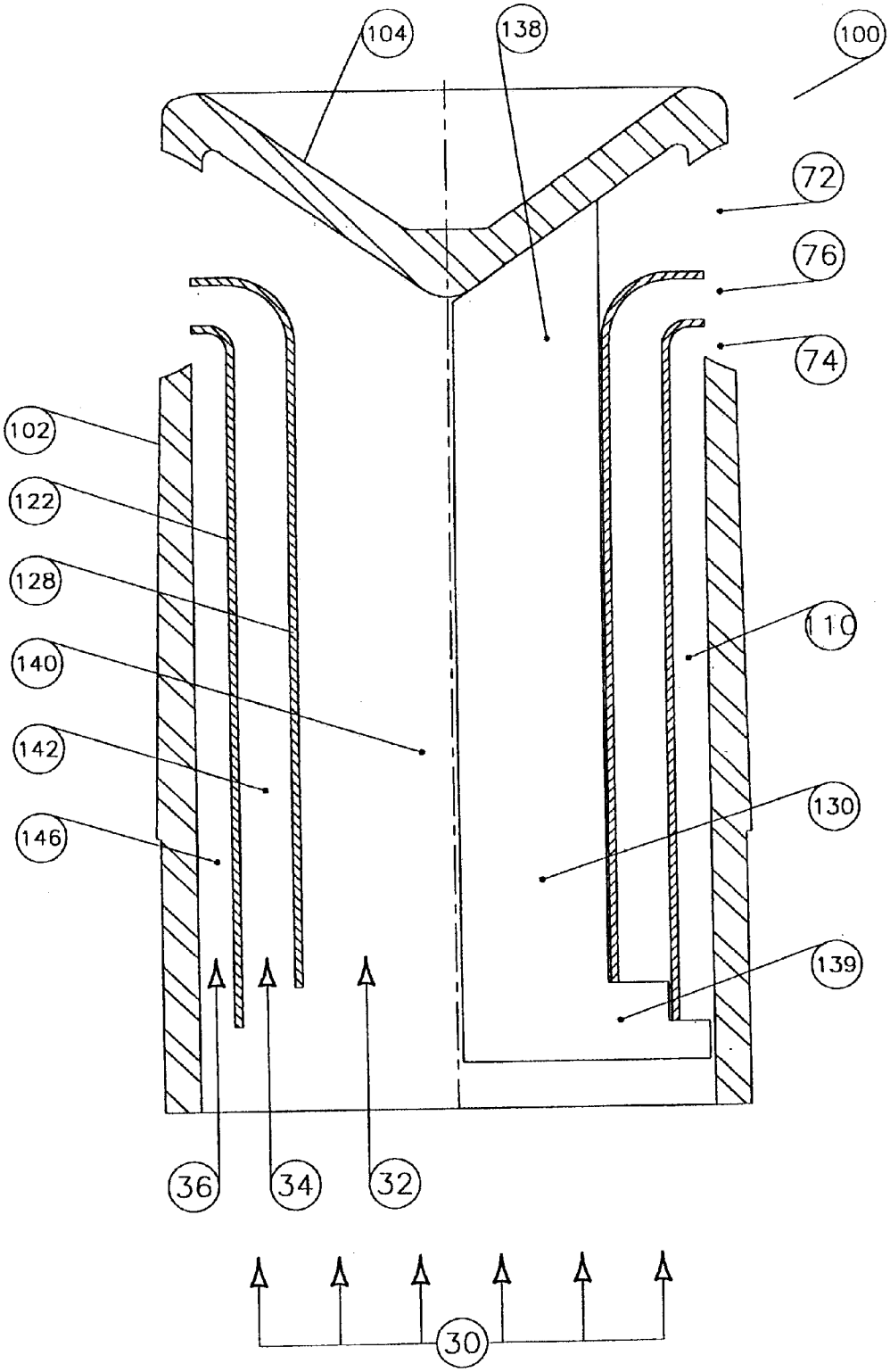
FIG. 11 is a cross-sectional view of FIG. 10 along line BB.

As illustrated in FIGS. 10 and 11, another embodiment 100 of the present invention comprises a burner pipe 102 having a flow divider 110 preferably provided in the interior of burner pipe 102 adjacent the downstream end. Flow divider 110 preferably comprises a plurality of nested members 120 within burner pipe 102 and a plurality of in-line members 130. The combination of nested members 120 and in-line members 130 divides the space within the interior of burner pipe 102.

In one aspect of this embodiment, flow divider 120 utilizes three in-line members 132, 134, and 136 along with two nested members 122 and 124 defining a core space 140, an annular space 142 and a midstream space 144. Each in-line member 132, 134, and 136 is a substantially L-shaped plate having a body portion 138 and a leg portion 139. Body portion 138 is positioned within core space 140 along its length and preferably extends to plug 104. Leg portion 139 extends radially outward toward the interior wall of burner pipe 102 and contacts the upstream ends of the nested members 122 and 124, as illustrated in FIG. 11. In this aspect, each in-line member 132, 134, and 136 in combination with the nested members 122 and 124 create three distinct flow regions for core space 140, as illustrated by numerals C1–C3.

It will be understood by those skilled in the art that in-line members 130 can alternatively extend into and divide the annular space 142, core space 140 and/or any or all of the midstream spaces 144, either individually or in combination.

While the invention has been described with a certain degree of particularity, it is manifest that many changes may be made in the details of construction and the arrangement of components without departing from the spirit and scope of this disclosure. It is understood that the invention is not limited to the embodiments set forth herein for purposes of exemplification, but is to be limited only by the scope of the attached claim or claims, including the full range of equivalency to which each element thereof is entitled.

What is claimed is:

1. A burner apparatus for furnaces comprising:

a burner pipe having a side wall, a distal end portion, and a plurality of lateral openings in said side wall around said distal end portion;

a flow divider comprising at least three in-line members within said burner pipe forming at least three longitudinal flow sections;

a gas fuel intake in said burner pipe upstream of said flow divider; and an air intake in said burner pipe upstream of said flow divider such that gas fuel from said gas fuel intake and air from said air intake will form a fuel and air fluid stream which will flow through said longitudinal flow sections of said flow divider and out of said lateral openings.

2. The burner apparatus of claim 1 wherein each of said in-line members extends from a common edge radially outward toward said side wall of said burner pipe.

3. The burner apparatus of claim 2 wherein each of said in-line members contacts said side wall of said burner pipe.

4. A burner apparatus for furnaces comprising:

a burner pipe having a side wall, a distal end portion, and a plurality of lateral openings through said side wall in said distal end portion;

a flow divider comprising a plurality of nested members within said burner pipe;

a gas fuel intake in said burner pipe upstream of said flow divider; and an air intake in said burner pipe upstream of said flow divider such that gas fuel from said gas fuel intake and air from such air intake will form a fuel and air fluid stream which will flow through said flow divider and out of said lateral openings, wherein said plurality of nested members include at least an inner member and an outer member such that said inner member is positioned within said outer member, a longitudinal core flow passage for said fuel and air fluid stream is provided through said inner member, a longitudinal annular flow space for said fuel and air fluid stream is provided between said outer member and said side wall, and at least one longitudinal intermediate flow space for said fuel and air fluid stream is provided between said inner member and said outer member.

5. The burner apparatus of claim 4 wherein said plurality of nested members are substantially coaxial.

6. The burner apparatus of claim 4 wherein said plurality of nested members are partially cylindrical nested members.

7. The burner apparatus of claim 4 wherein the number of said plurality of nested members is three such that two intermediate longitudinal flow spaces for said fuel and air fluid stream are provided between said inner member and said outer member.

8. The burner apparatus of claim 4 wherein each of said plurality of nested members has a flared downstream end intersecting said lateral openings.

9. The burner apparatus of claim 8 wherein said flared downstream end of each of said plurality of nested members is a curved end portion.

10. The burner apparatus of claim 8 wherein said flared downstream end of each of said plurality of nested members is substantially perpendicular to said lateral openings.

11. The burner apparatus of claim 8 wherein said flared downstream ends of said plurality of nested members divide each of said openings into a plurality of opening sections.

12. The burner apparatus of claim 11 wherein:

said flared downstream ends of said plurality of nested members divide each of said lateral openings into a downstream opening section, an upstream opening section, and at least one intermediate opening section, and wherein a first portion of said fuel and air fluid stream will flow through said core flow passage then outwardly through said downstream opening sections, a second portion of said fuel and air fluid stream will flow through said annular flow space thence outwardly through said upstream opening sections, and a third portion of said fuel and air fluid stream will flow through said intermediate flow space thence outwardly through said intermediate opening sections.

13. A burner apparatus for furnaces comprising:

a burner pipe having a side wall, a distal end portion, and a plurality of lateral openings through said side wall in said distal end portion;

a flow divider within said burner pipe;

a gas fuel intake in said burner pipe upstream of said flow divider; and an air intake in said burner pipe upstream of said flow divider such that gas fuel from said gas fuel intake and air from said air intake will form a fuel and air fluid stream which will flow through said flow divider and out of said late openings, wherein said flow divider comprises a plurality of nested members including at least an outer member positioned within said side wall of said burner pipe and an innermost member positioned within said outer member such that a longitudinal core flow passage for said fuel and air fluid stream is provided though said innermost member, a longitudinal annular flow space for said fuel and air fluid stream is provided between said outer member and said side wall, and at least one longitudinal intermediate flow space for said fuel and air fluid stream is provided between said innermost member and said outer member, and a plurality of in-line members which divide at least said core flow passage into at least three parts.

14. The burner apparatus of claim 13 wherein said plurality of nested members are substantially coaxial.

15. The burner apparatus of claim 13 wherein said plurality of nested members are partially cylindrical nested members.

16. The burner apparatus of claim 13 wherein said plurality of in-line members extend from a common edge radially outward toward said side wall of said burner pipe.

17. The burner apparatus of claim 16 wherein each of said plurality of in-line members contacts said side wall of said burner pipe.

18. The burner apparatus of claim 13 wherein each of said in-line members comprises:

a body portion positioned along the length of said plurality of nested members; and a leg portion extending radially outward toward said side wall of said burner pipe.

19. The burner apparatus of claim 18 wherein each of said nested members has an upstream end and a downstream end, and said leg portion of each of said in-line members contacts said upstream end of each of said nested members.

20. The burner apparatus of claim 13 wherein each of said plurality of nested members has a flared downstream end portion which intersects said lateral openings.

21. The burner apparatus of claim 20 wherein said flared downstream end portions of each of said plurality of nested members are curved.

22. The burner apparatus of claim 20 wherein said flared downstream end portions of said plurality of nested members are substantially perpendicular to said lateral openings.

23. The burner apparatus of claim 20 wherein said flared downstream end portions of said plurality of nested members divide each of said lateral openings into a plurality of opening sections.

24. The burner apparatus of claim 23 wherein:

said flared downstream end portions of said plurality of nested members divide each of said openings into a downstream opening section, an upstream opening section, and at least one intermediate opening section, and wherein a first portion of said fuel and air fluid stream will flow through said core flow passage then outwardly through said downstream opening sections, a second portion of said fuel and air fluid stream will flow through said annular flow space thence outwardly through said upstream opening sections, and a third portion of said fuel and air fluid stream will flow through said intermediate flow space thence outwardly through said intermediate opening section.

* * * * *